US007073692B2

(12) United States Patent
Weyts

(10) Patent No.: US 7,073,692 B2
(45) Date of Patent: Jul. 11, 2006

(54) CONICAL REINFORCED RE-SEALABLE DISPENSER

(76) Inventor: Pieter Weyts, 333 W. 56th St., #2K, New York, NY (US) 10019

( * ) Notice: Subject to any disclaimer, the term of this patent is extended or adjusted under 35 U.S.C. 154(b) by 381 days.

(21) Appl. No.: 10/782,218

(22) Filed: Feb. 19, 2004

(65) Prior Publication Data

US 2005/0184088 A1 Aug. 25, 2005

(51) Int. Cl.
*B65D 47/10* (2006.01)

(52) U.S. Cl. ..... 222/541.9; 222/215; 383/104

(58) Field of Classification Search ..... 222/541.9, 222/92, 215, 207, 153.07, 153.08, 206; 383/104, 383/200–206
See application file for complete search history.

(56) References Cited

U.S. PATENT DOCUMENTS

| | | | | |
|---|---|---|---|---|
| 978,843 | A | 12/1910 | Burns | |
| 1,294,011 | A | 2/1919 | Williams | |
| 1,347,231 | A | 7/1920 | Rothermel | |
| 1,438,487 | A | 12/1922 | Greene | |
| 1,817,732 | A | 8/1931 | Boruss | |
| 2,099,412 | A | 11/1937 | Seidler | |
| 2,103,389 | A * | 12/1937 | Salfisberg | 222/107 |
| 2,248,266 | A | 7/1941 | Abrams | |
| 2,517,027 | A | 8/1950 | Rado | |
| 3,009,498 | A | 11/1961 | Fohr | |
| 3,172,796 | A | 3/1965 | Gulker | |
| 3,184,121 | A * | 5/1965 | Volckening | 222/213 |
| 3,278,085 | A * | 10/1966 | Brown | 222/107 |
| 3,438,567 | A | 4/1969 | Bell, Jr. | |
| 3,635,376 | A * | 1/1972 | Hellstrom | 222/107 |
| 3,741,384 | A | 6/1973 | Cloud | |
| 4,759,472 | A * | 7/1988 | Strenger | 222/92 |
| D308,019 | S | 5/1990 | Mileos | |
| 4,928,852 | A * | 5/1990 | Guiffray | 222/107 |
| 5,018,646 | A | 5/1991 | Billman et al. | |
| 5,411,178 | A * | 5/1995 | Roders et al. | 222/105 |
| 5,676,990 | A | 10/1997 | Wawrzynski | |
| 5,839,609 | A * | 11/1998 | Zakensberg | 222/107 |
| D402,197 | S | 12/1998 | Poulin | |
| 6,241,132 | B1 * | 6/2001 | Morrison | 222/541.6 |
| 6,267,507 | B1 | 7/2001 | de Laforcade | |
| 2001/0042757 | A1 | 11/2001 | Kuge et al. | |
| 2002/0127308 | A1 | 9/2002 | Suzuki et al. | |

* cited by examiner

*Primary Examiner*—Lien M. Ngo
(74) *Attorney, Agent, or Firm*—Cooper & Dunham LLP

(57) ABSTRACT

A container and dispenser in conical shape for liquid or semi-liquid substances. The container features a rectangular rigid tab, two triangular notches on both sides of the tab at the height slightly below the tip of the cone, a perforated or indented scoreline to facilitate tearing off or cutting the top region of the tab, which is less rigid than the rest of the tab, where the top region of the container is made of a different material than the rest of the cone creating a zone of weakness at the indented dividing line between the top region and the rest of the cone and allows the user to easily tear off the top region of the tab and remove the top region of the cone opening a passageway in the tip of the cone where the substance can leave the dispenser by pressing the collapsible walls or back of the dispenser, without the need for a utensil. Also, a yarn or thread may be attached to the tab along the scoreline of the tab and the dividing line of the cone to further facilitate the tearing off of the top region of the tab and the cone. In addition, the middle region of the cone is made in a foil-like material that makes the cone re-sealable by pressing the walls of the middle region against each other.

7 Claims, 14 Drawing Sheets

FIG. 14
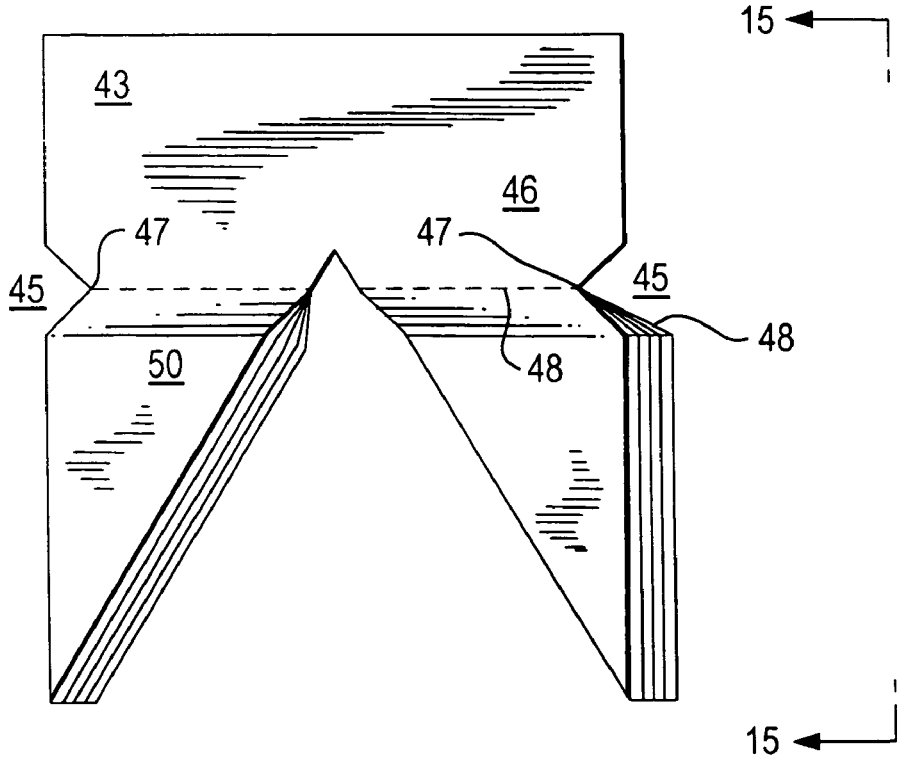
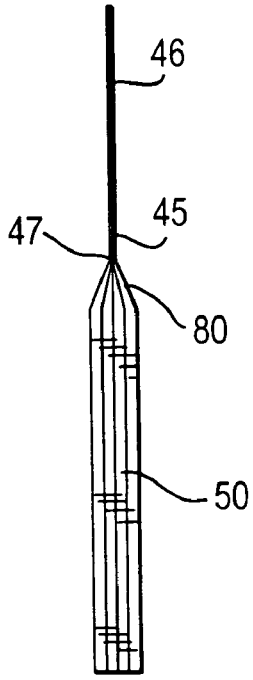
FIG. 15

CONICAL REINFORCED RE-SEALABLE DISPENSER

FIELD OF THE INVENTION

The present invention is generally directed to a novel device in conical shape with a reinforcing rigid tab for holding and dispensing in a measured and precise manner liquids or semi-liquids where such devices can be easily and conveniently opened without the need for a knife, scissors or other utensil and easily resealed.

BACKGROUND OF THE INVENTION

The present invention addresses the need for a dispenser or container of fluid or semi-fluid substances which: a) allows the substance to be applied in a measured and precise manner, b) is easy and convenient to use, c) can be opened and used without the need for a utensil or other device, d) can be easily resealed, and e) is simple and economical to manufacture. Hereinafter, the terms "container" and "dispenser" are used interchangeably.

Measured and precise. In numerous instances of consumption of fluid or semi-fluid substances, there is a need for a dispenser that allows the substance to be applied in a measured and precise manner. For example, a person eating french fries may want to dispense a small portion of ketchup on the fries; a person eating a bagel or bread roll may want to use a small portion of spread-able cheese, jam, or chocolate paste; a person eating a salad may want a small portion of salad dressing; a hotel guest may require a small portion of shampoo or soap for an overnight stay. In all these instances, consumers want to be able to apply the substance where they want it, and in the volume they want it.

Easy to use. In general, containers, like any consumer product, have to be easy and convenient to use. This need is even more acute for containers of relatively small portions. When the portion to be consumed is relatively small, people do not want to encounter too many practical obstacles in opening the container and dispensing the small portion. Consumers rather want the small portions to be easily dispensable without spending much time opening the container or ensuring that the content be dispensed in a proper and accurate manner.

No need for utensil. Many existing containers require a utensil to be opened, or to dispense the content of the container. For example, a container may require a knife to be opened, or a fork or spoon to dispense the substance of the container. The need for a utensil makes the container cumbersome to use thereby greatly diminishing its practicality and attractiveness to consumers. Again this is particularly true for containers and dispensers of small portions, where the small size of the content to be dispensed may not justify the extra burden of effort or time of using a utensil. The use of a utensil to open the container or dispense its content would generally require an investment of time and effort that consumers would prefer not to make if they had a choice. Therefore, consumers would prefer a container that can be opened and used without the need for a utensil or other device.

Re-sealability. When consumers use a dispenser, they do not necessarily want to consume all of the contents of the dispenser. Therefore, consumers prefer a dispenser that can be easily re-sealed which allows them to consume the remainder of the contents of the dispenser at a later time.

Easy and economical to manufacture. Because the value of the substance to be dispensed may not always be very high, it is preferable that the dispenser be easy and relatively cheap to manufacture.

SUMMARY OF THE INVENTION

The present invention is directed to a container and dispenser in conical shape and a method of manufacturing such container for dispensing liquids or semi-liquids. The container is constructed of collapsible, waterproof material, and the liquid or semi-liquid is completely enclosed and sealed within the dispenser. A rectangular rigid tab is attached to the sidewalls of the container enclosing the tip of the cone within the tab, maintaining the shape of the cone and allowing the content to be dispensed in a measured and precise manner even when the volume of the substance within the cone decreases. The tab features two triangular notches on both sides of the tab, at a height slightly below the tip of the cone, and a perforated or indented scoreline at the same height to facilitate tearing off or cutting the top region of the tab and the top region of the cone. Also, the region of the tab above the scoreline is less rigid and thinner than the region of the tab below the scoreline to facilitate the tearing or cutting off of the top region of the tab. Similarly, the top region of the cone is made of a different material than the rest of the cone creating a zone of weakness at the dividing line between the top region and the rest of the cone, and such dividing line is slightly indented in order to facilitate the tearing or cutting off of the top region of the cone. In addition, a yarn or thread may be attached to the tab along the scoreline and the dividing line between the top region and the rest of the cone to further facilitate the tearing or cutting off of the top region of the tab and the cone. After the top portion of the tip has been removed, the user can easily dispense the substance in a precise and measured manner by pressing the collapsible walls or back of the dispenser without the need for a knife, scissors or other utensil. Further, the middle region of the cone is made in tin foil or similar material which makes that region of the cone easily re-sealable by simply pressing the walls of the middle region of the cone.

BRIEF DESCRIPTION OF THE DRAWINGS

FIGS. 14, 16, 17, 18 and 19 show different embodiments of a component of the invention: the rectangular tab before it has been attached to the sidewalls.

FIG. 15 shows a side view of the embodiment of a component of the invention as shown in FIG. 14 taken approximately along the line 15—15 of FIG. 14.

DETAILED DESCRIPTION OF THE PREFERRED EMBODIMENTS

Reference will now be made in detail to the preferred embodiments of the invention, examples of which are also provided in the following description. Exemplary embodiments of this invention are described in some detail, although it will be apparent to those skilled in the relevant art that some features which are not particularly relevant to the invention may not be shown for the sake of clarity. Therefore, the examples provided are primarily given in the context of a conical dispenser made from flexible plastic material. Nevertheless, it should be obvious that the invention also contemplates applications using other flexible waterproof material, not made of plastic. Also, the examples provided are primarily given in the context of a dispenser for small portions of liquid or semi-liquid consumer goods. Nevertheless, it should be obvious that the invention contemplates applications in any size, from very big to extra-small, and applications to containers outside the area of consumer goods, and for any substance, edible or non-edible.

The present invention is directed to a dispenser and a method of manufacturing a dispenser in conical shape for dispensing liquids or semi-liquids in a precise manner. The dispenser is constructed of collapsible material and the liquid or semi-liquid is completely enclosed and sealed within the dispenser. The dispenser is made of at least one layer of a material chosen from paper, plastic, tin foil, metal or a combination thereof.

Figure 1:
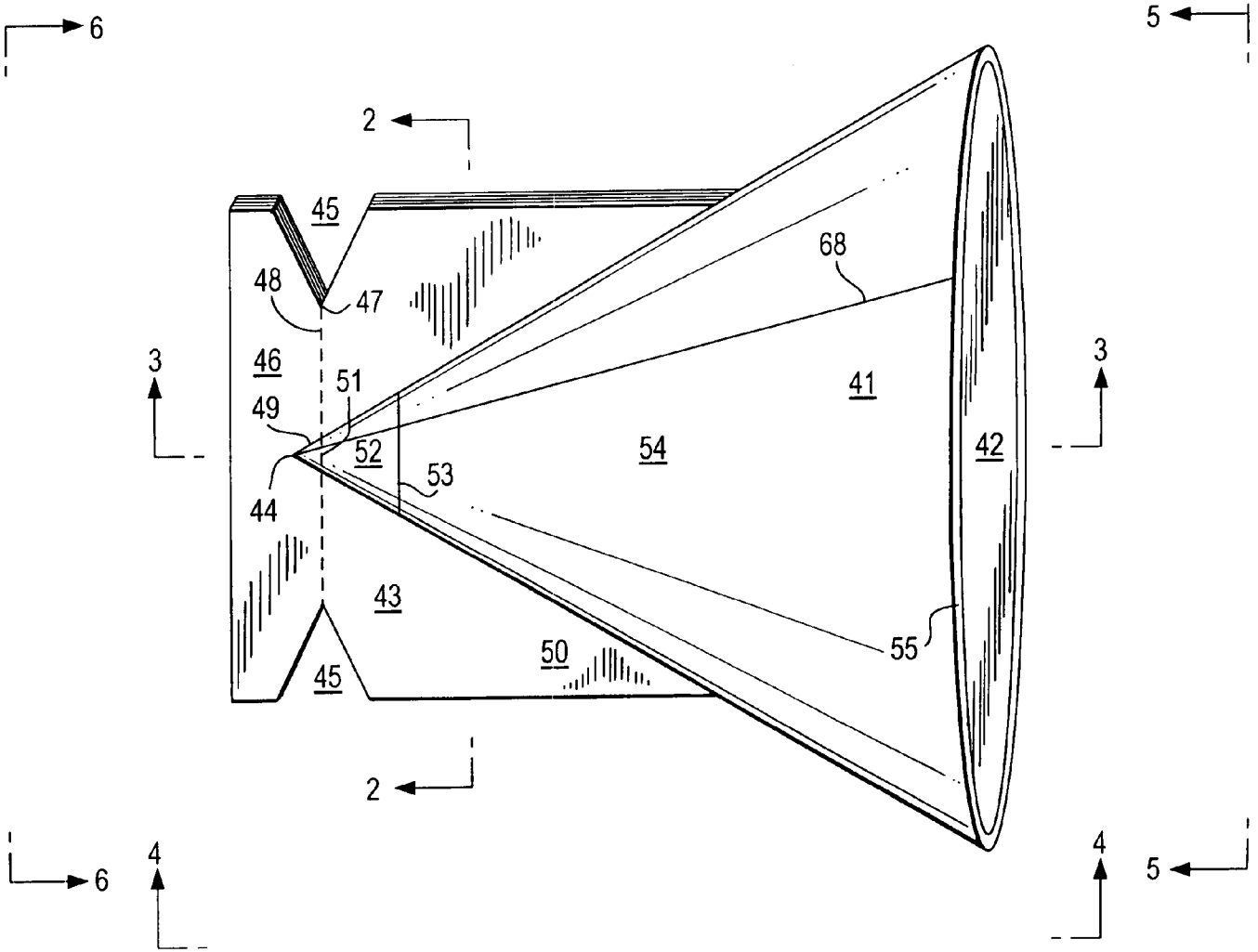
FIG. 1 shows an embodiment of the dispenser in a horizontal position.

FIG. 1 shows the dispenser in a horizontal position showing the three main components: the sidewalls of the cone 41, the back of the cone 42 and the rectangular tab 43. Both the back of the cone 42 and the sidewalls 41 are made of collapsible, waterproof material such as plastic or tin foil. The tab 43 is flat and is made of a rigid material which serves to maintain the shape and stiffness of the cone even when the volume of the substance contained in the dispenser decreases. In the absence of a tab, the cone could not maintain its shape on its own as the volume of the substance contained within would decrease. Another function of the tab is to facilitate the opening of the dispenser at the tip of the cone. Still referring to FIG. 1, the tab features two triangular notches 45 at both sides of the tab 43. The user of the dispenser can choose either side of the tab to start tearing off the top region 46 of the tab 43 starting at the inner tip 47 of either triangular notch 45 and continuing along a perforated or indented scoreline 48 which runs from one side of the tab to the other and intersects with the top region 49 of the cone. In the preferred embodiment of the invention, the tab 43 is composed of an extra rigid and thicker region 50 below the scoreline 48 and a less rigid, thinner region 46 above the scoreline. The less rigid, thinner upper region 46 of the tab makes it easier for the user of the dispenser to tear off that portion of the tab to open the dispenser while the extra rigid, thicker lower region of the tab maintains the conical shape of the dispenser, even after it has been opened, and regardless of how much substance has been dispensed and left the cone. To start tearing off the upper region 46 of the tab, the user of the dispenser may hold the dispenser by keeping the lower part of the tab between index and thumb of one hand, and the upper part of the tab between index and thumb of the other hand, and start moving the two hands in opposite directions creating the most pressure at the inner tip 47 of the triangular notch 45 that is located at the side of the tab where the user is holding the dispenser. As the pressure builds, the tab will start tearing apart at such inner tip.

In the preferred embodiment of the invention, the collapsible walls 41 of the cone are made of a combination of three different materials creating three separate regions in the walls of the cone. First, the top region 49 of the cone runs from the tip 44 of the cone until an upper dividing line 51. Second, the middle region 52 of the cone runs from the upper dividing line 51 until a lower dividing line 53, which is located between the upper dividing line 51 and the circular border 55 where the circular back of the cone 42 is attached to the sidewalls of the cone 41. Third, the lower region 54 of the cone runs from the lower dividing line 53 to the circular border 55.

Still referring to FIG. 1, the upper dividing line 51 is in line with the perforated or indented scoreline 48 in the tab 43. When the user of the dispenser has torn off part of the upper region of the tab starting at the inner tip 47 of either triangular notch 45 and continuing along the perforated or indented scoreline 48 until reaching the upper dividing line 51 in the top region 49 of the cone, the user can continue his tearing movement along the dividing line 51 to also tear off the top region 49 of the cone, and even the other side of the tab along the dividing line on the other side. In order to facilitate the continuation of the tearing movement of the user and the removal of the upper region of the cone, the dividing line 51 is slightly indented. Also, the top region 49 of the cone is more strongly attached to the upper region 46 of the tab than to the middle region 52 of the cone in order to ensure that the tearing off of the top region 49 would more naturally engender the tearing off of the upper region 46 of the tab when the user continues the tearing movement when it reaches the dividing line 51.

Figure 7:
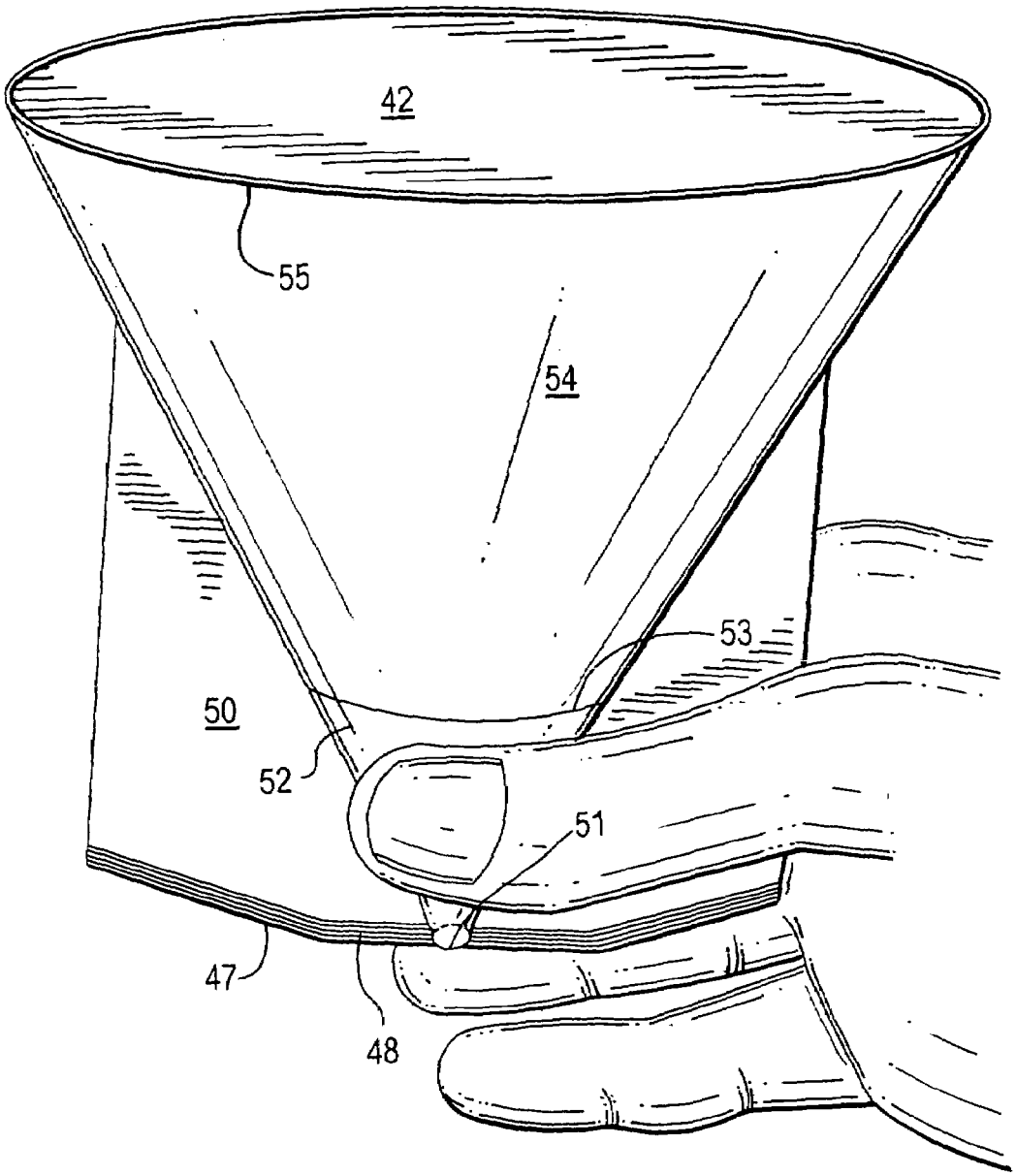
FIG. 7 shows an embodiment of the dispenser after the dispenser has been opened.

When the user has removed the top region 49 of the cone and the upper region 46 of the tab, the user is left with the extra rigid, thicker region 50 of the tab and the lower region 54 of the cone, and the user has effectively and easily opened a passageway for the substance to leave the dispenser at the new tip of the dispenser which is the remaining part of the dividing line 51. FIG. 7 shows the dispenser after the top region 49 of the cone and the upper region 46 of the tab have been removed. The user can now dispense the substance of the cone in a precise manner by pointing the new tip 51 of the dispenser to the spot where the substance is to be dispensed. Also, the user can now dispense the substance of the cone in a measured manner by more or less pressing the collapsible walls of the middle region 52 or the lower region 54 or the back 42 of the cone.

Still referring to FIG. 7, in the preferred embodiment of the invention, the middle region 52 of the collapsible walls of the dispenser is made of tin foil. After the user has opened the dispenser, in the manner described above, and has used it to dispense some of the substance of the cone, there will be spare space available within the dispenser. The user will be able to use this spare space to press the walls of the middle region 52 against each other, particularly at or near the new tip 51 of the dispenser, where the cone is not as wide yet. By pressing the walls of the middle region in tin foil, the user will in effect be able to re-seal the dispenser as it will close off the tip of the cone hermetically. It will be obvious to those skilled in the art that the sealing effect may also be achieved by other materials than tin foil. Once the cone is resealed, the user can store the cone for use at a later time while keeping the substance of the cone in good condition.

Figure 2:
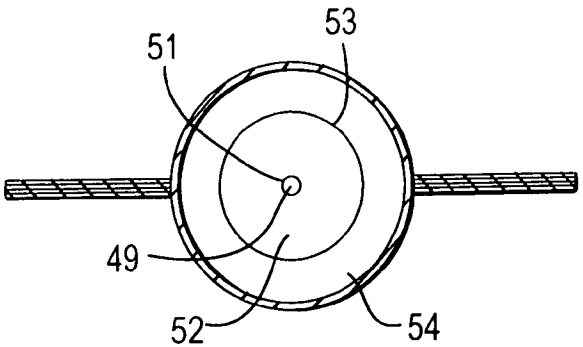
FIG. 2 shows a transverse sectional view of the embodiment of FIG. 1 taken approximately along the line 2—2 of FIG. 1.

FIG. 2 shows a transverse sectional view of the dispenser taken approximately along the line 2—2 of FIG. 1 showing the top region 49, the middle region 52 and part of the lower region 54 of the cone, and the upper dividing line 51 and the lower dividing line 53 from the inside. FIG. 2 also shows part of the extra rigid, thicker region 50 of the tab 43 below the scoreline 48.

Figure 3:
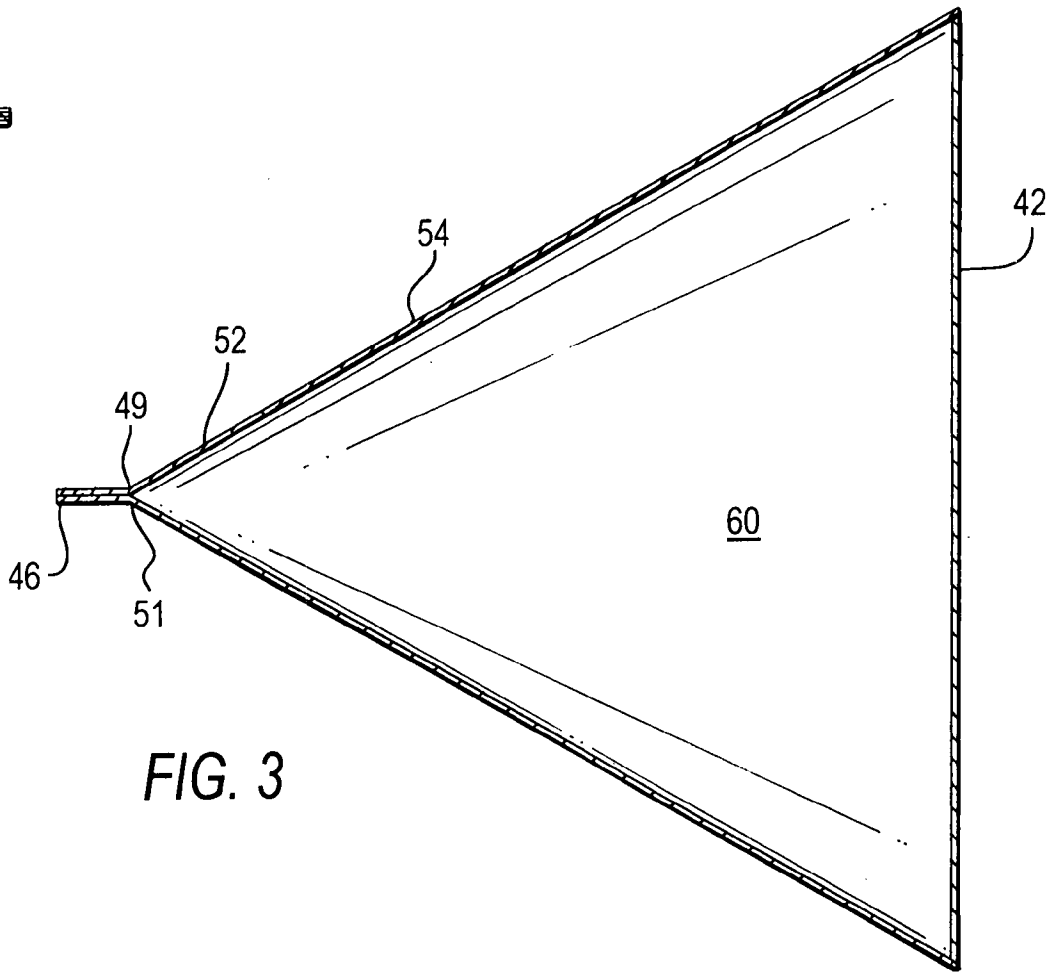
FIG. 3 shows a longitudinal cross section of the embodiment of FIG. 1 taken approximately along the line 3—3 of FIG. 1.

FIG. 3 shows a longitudinal cross section of the dispenser taken approximately along the line 3—3 of FIG. 1 showing the top region 49, the middle region 52 and the lower region 54 of the cone, and the upper region 46 of the tab. FIG. 3 also shows half of the chamber 60 within the collapsible walls of the cone where the substance to be dispensed will be maintained before being dispensed.

Figure 8:
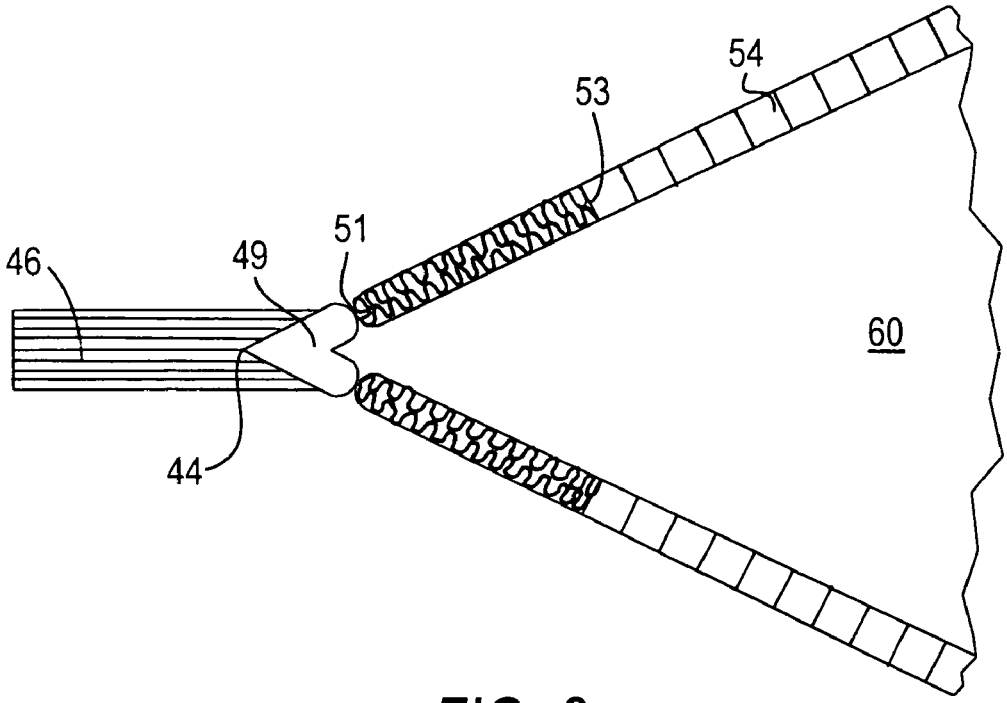
FIG. 8 shows an expanded view of part of the cross-sectional view of the embodiment of FIG. 3.

FIG. 8 shows an expanded view of part of the cross-sectional view of FIG. 3. FIG. 8 shows the upper region 46 of the tab, the top region 49, the middle region 52 and part of the lower region 54 of the cone, and part of the chamber 60 within the collapsible walls of the cone. FIG. 8 also shows more clearly the indentation at the upper dividing line 51, which allows the user of the cone to more easily tear off the top region 49 of the cone. It will be obvious that other embodiments of the dispenser could provide for more or less indentation, or for other features facilitating the tearing off of the top region 49, at the dividing line 51 in order to optimize the functionality and user-friendliness of the invention.

Figure 9:
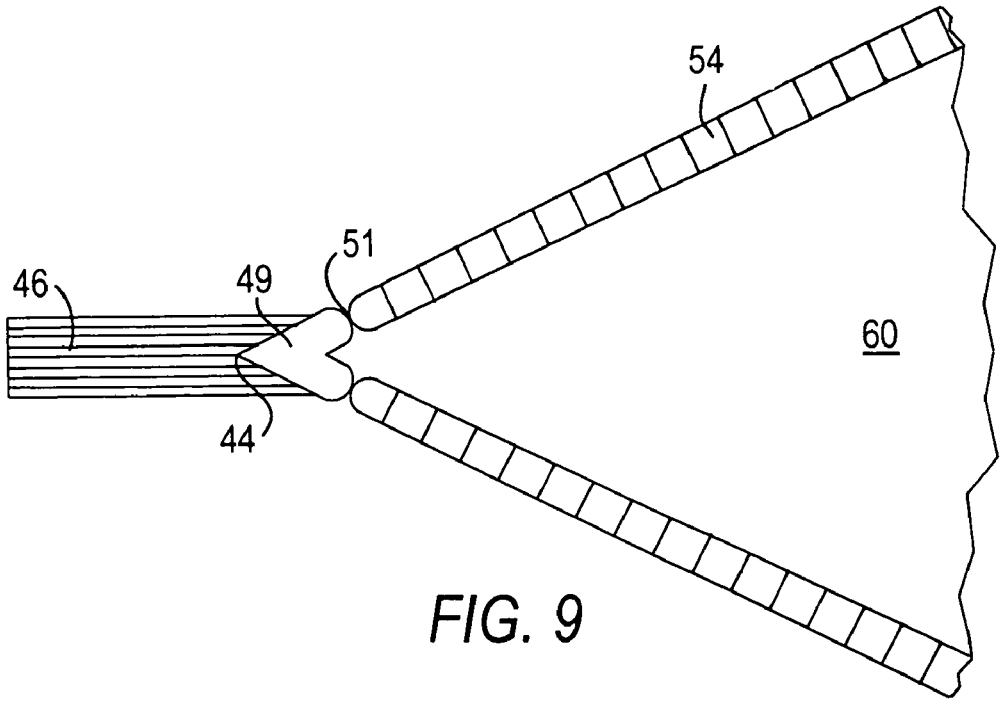
FIG. 9 shows an expanded view of part of a cross-sectional view of an embodiment of the dispenser.

FIG. 9 shows an expanded view of part of a cross-sectional view of part of the invention in an another embodiment where the dispenser is otherwise as shown in FIG. 1, FIG. 3 and FIG. 8, with the exception that there is no middle region 52 of the cone. Instead, the collapsible walls 41 of the cone are made of a combination of only two different materials creating only two separate regions in the walls of the cone: first, the top region 49 of the cone which runs from the tip 44 of the cone until the upper dividing line 51, and second, the lower region 54 of the cone which runs from the upper dividing line 51 to the circular border 55. In this embodiment, the lower region 54 of the cone may be made of tin foil or a material with similar characteristics, like the middle region 52 in the embodiment as described in FIG. 8, thereby also granting to this embodiment the feature of re-sealability to the lower region 54 of the cone.

Figure 4:
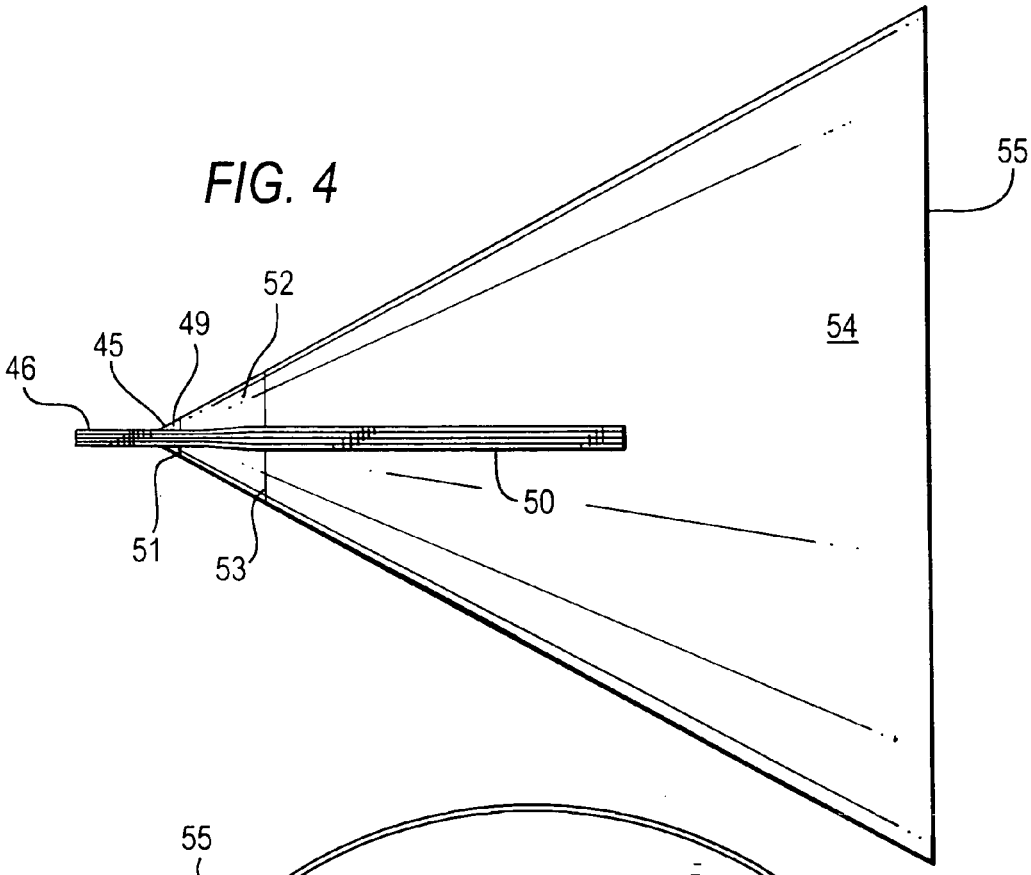
FIG. 4 shows a perpendicular view of the embodiment of FIG. 1 taken approximately along the line 4—4 of FIG. 1.

FIG. 4 shows a perpendicular view of the dispenser taken approximately along the line 4—4 of FIG. 1 showing the top region 49, the middle region 52, and the lower region 54 of the cone, the upper dividing line 51 and the lower dividing line 53, the circular border 55, the extra rigid and thicker lower region 50 of the tab, and the less rigid, thinner upper region 46 of the tab, and the triangular notch 45 that is visible on this side of the dispenser.

Figure 5:
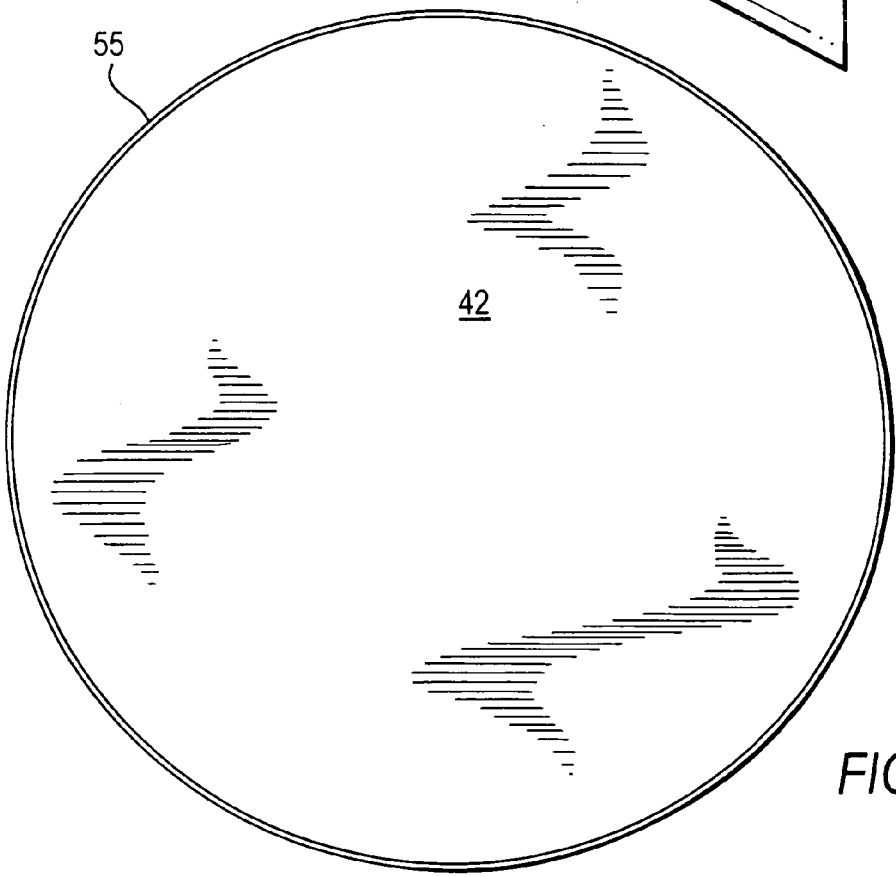
FIG. 5 shows a frontal view of the embodiment of FIG. 1 taken approximately along the line 5—5 of FIG. 1.

FIG. 5 shows a frontal view of the back of the cone 42 taken approximately along the line 5—5 of FIG. 1. The back of the cone 42 is circular and flat and is attached to the sidewalls 41 of the cone at the circular border 55.

Figure 6:
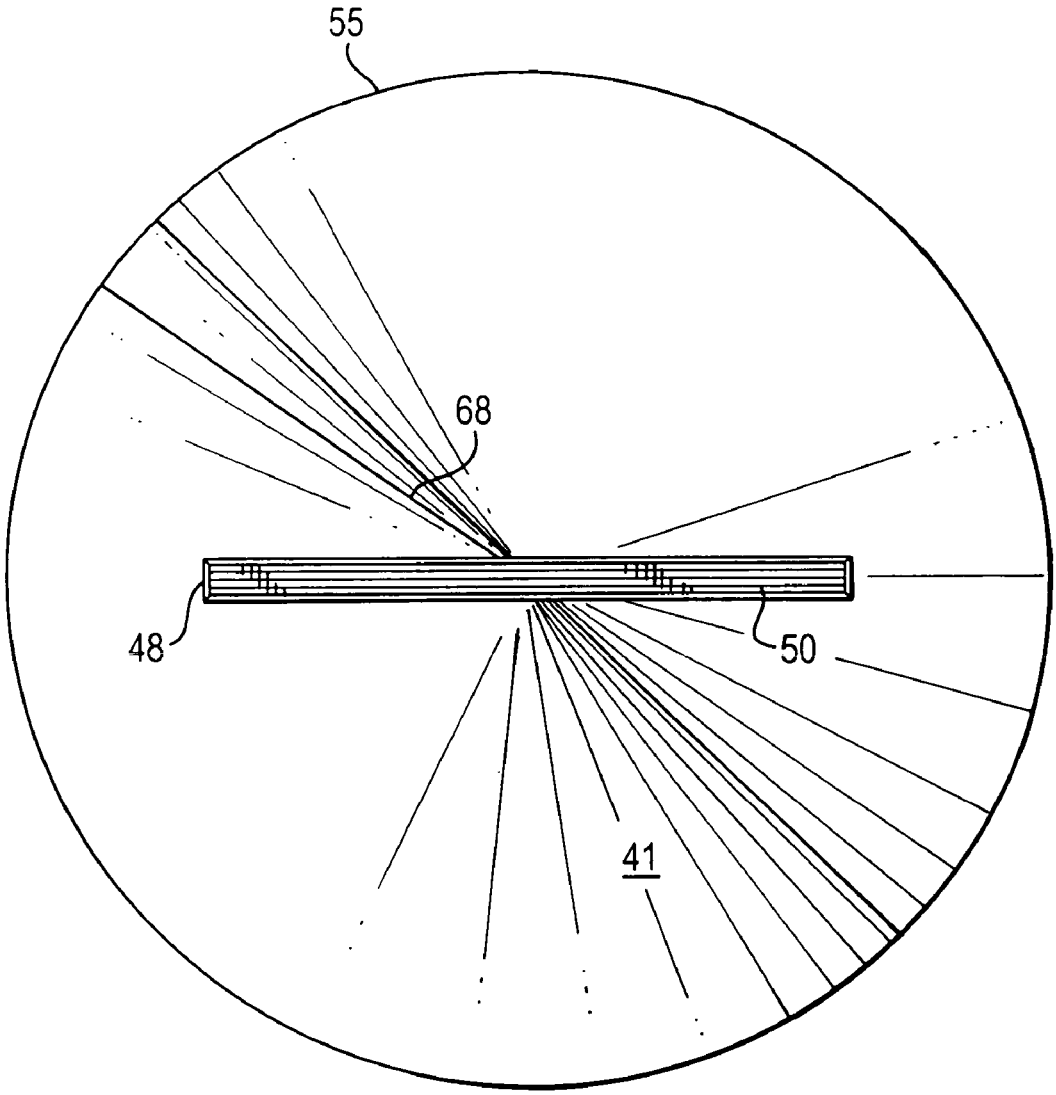
FIG. 6 shows a frontal view of the embodiment of FIG. 1 taken approximately along the line 6—6 of FIG. 1.

FIG. 6 shows a frontal view of the cone taken approximately along the line 6—6 of FIG. 1 showing the less rigid, thinner upper region 46 of the tab and the extra rigid lower region 50 of the tab, which sticks out because it is thicker than the upper region 46. FIG. 6 also shows the sidewalls 41 of the cone, which are gradually wider the closer they are to the circular border 55 where they are attached to the back of the cone 42, and conversely, which are gradually narrower the closer they are to the tip 44 of the cone which is enclosed in the upper region 46 of the tab.

Figure 10:
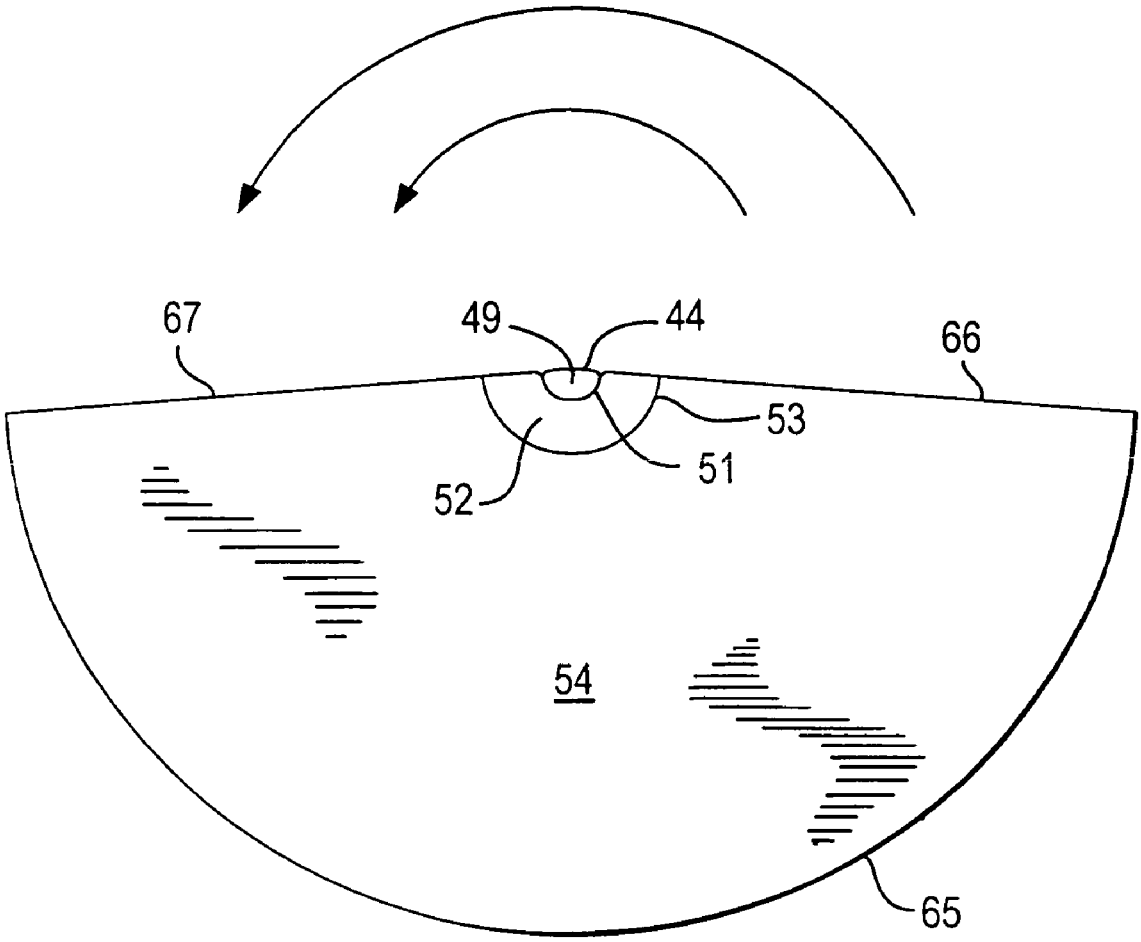
FIG. 10 shows an embodiment of the sheet used to manufacture a component of the invention: the sidewalls of the cone.

The manufacturing of the sidewalls 41 of the dispenser in conical shape involves the folding of a sheet in flexible material in the shape as shown in FIG. 10, in which one side 66 of the sheet is joined together with the other side 67 of the sheet creating a chamber in conical form where 44 is the tip of the chamber and the remaining side 65 of the sheet is at the bottom of the chamber. The joining of the two sides 66 and 67 will create a side seam 68 which may remain visible in the final embodiment of the invention, as shown in FIG. 1 and FIG. 6. The remaining side 65 of the sheet will be attached to the back of the cone 42 thereby forming the circular border 55, which will constitute the circumference of the bottom of the dispenser, as shown in FIG. 1 and FIG. 7. As shown in FIG. 10, the sheet which will constitute the sidewalls 41 of the dispenser is made up of three regions which will constitute the three different regions of the cone: a top region 49, a middle region 52, and a lower region 54, divided by the upper dividing line 51 and the lower dividing line 53 respectively. As described above, the upper dividing line 51 is slightly indented to allow the user of the dispenser to more easily tear off the top region 49.

Figure 11:
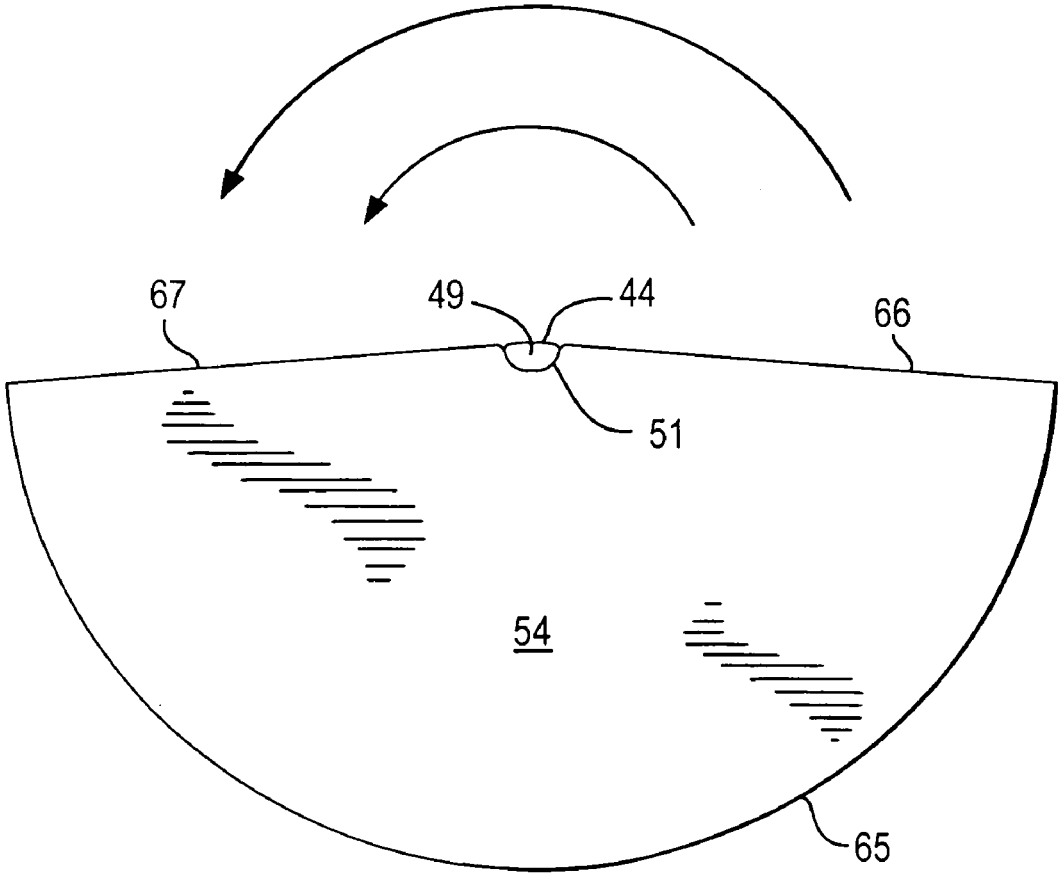
FIG. 11 shows another embodiment of the sheet used to manufacture a component of the invention: the sidewalls of the cone.

FIG. 11 is a view corresponding to FIG. 10 showing the sheet which is used to create the sidewalls 41 of the dispenser except that it shows the sheet that is used for the dispenser in the embodiment as described above in FIG. 9 in which there is no middle region 52 of the cone. Accordingly, the sheet is made of a combination of only two different materials creating only two separate regions in the walls of the cone: the top region 49 and the lower region 54 of the cone, divided by the upper dividing line 51.

Figure 12:
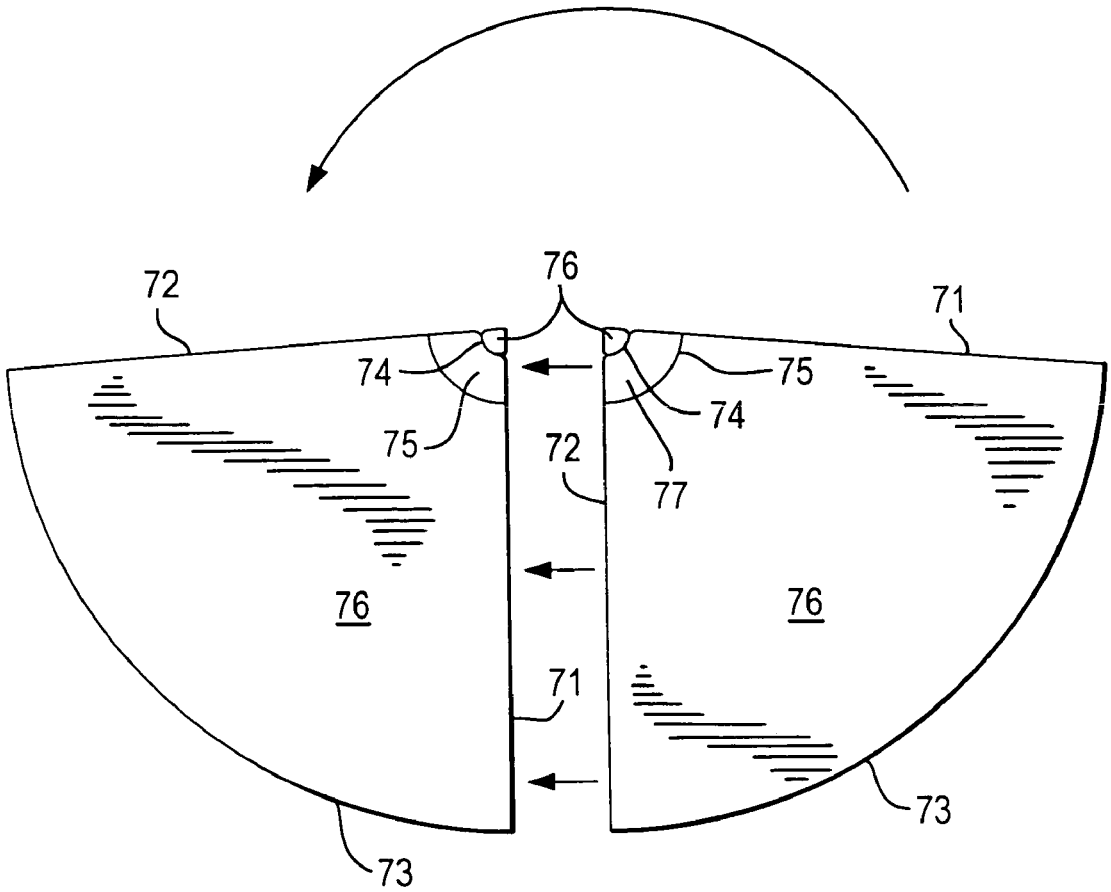
FIG. 12 shows an embodiment of two sheets used to manufacture a component of the invention: the sidewalls of the cone.

The sidewalls 41 of the dispenser could also be manufactured using two identical sheets in flexible material in the shape as shown in FIG. 12, rather than folding one sheet as described above. In such embodiment, the two sides 71 and 72 will be joined with the two sides 72 and 71 of the other sheet respectively, creating a chamber in conical form similar to the embodiments described above. In particular, the two remaining sides 73 of the two sheets in FIG. 12 are similar to the remaining side 65 of FIG. 10 which will be attached to the back of the cone 42; the joined top regions 76 of the sheet in FIG. 12 are similar to the top region 49 of FIG. 10; the joined middle regions 77 of the sheet in FIG. 12 are similar to the middle region 52 of FIG. 10; the joined lower regions 78 of the sheet in FIG. 12 are similar to the lower region 54 of FIG. 10; the joined upper dividing lines 74 of the sheet in FIG. 12 are similar to the upper dividing line 51 of FIG. 10; the joined lower dividing lines 75 of the sheet in FIG. 12 are similar to the lower dividing line 53 of FIG. 10. Similar to the embodiment described in FIG. 10, the upper dividing lines 74 are slightly indented to allow the user of the dispenser to more easily tear off the joined top regions 76. It will be obvious to those skilled in the art that there are alternative processes which enable the manufacturing of the sidewalls in conical shape where one or more sideseams, or no sideseams at all, will be visible in the final embodiment of the invention.

Figure 13:
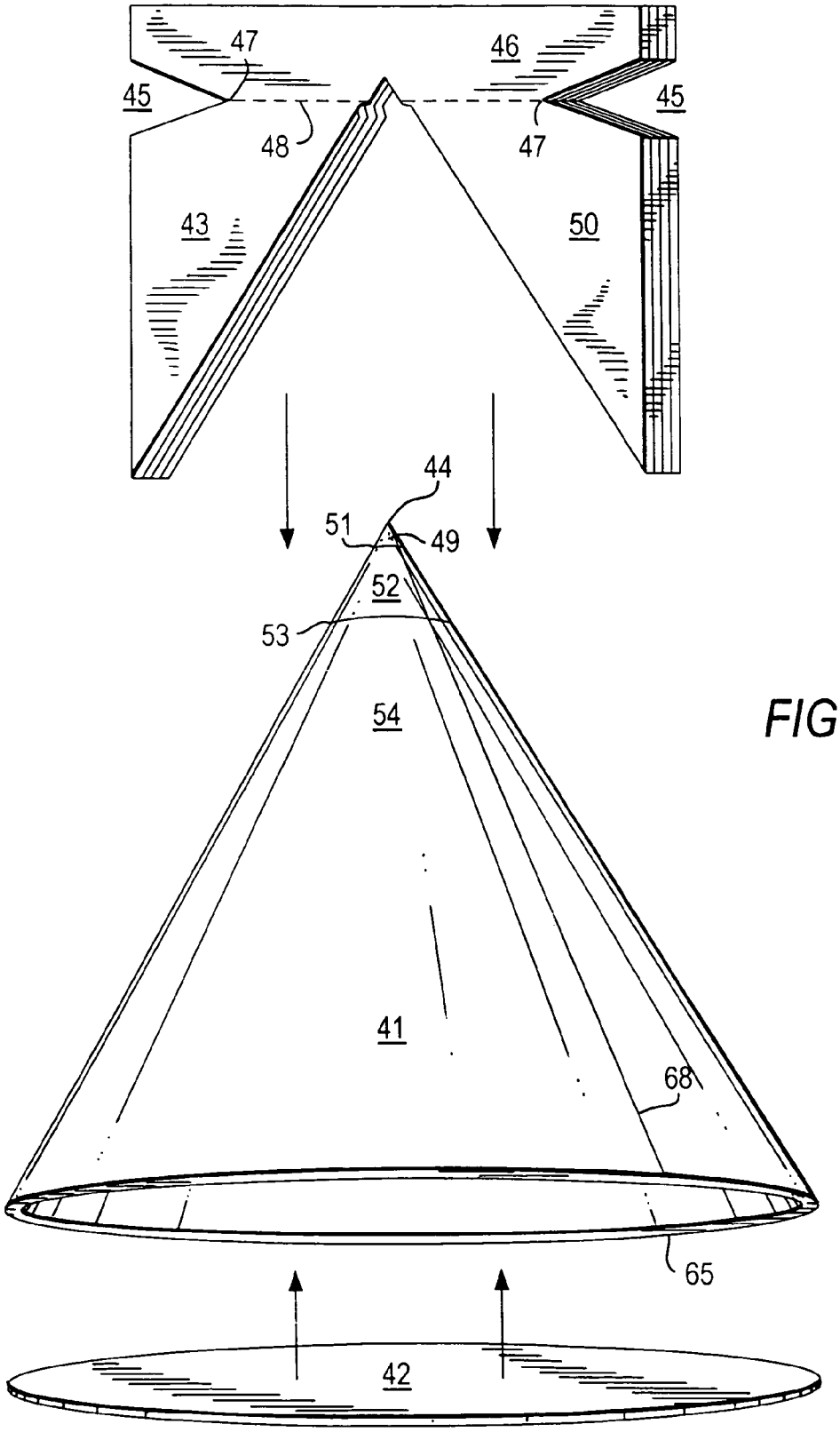
FIG. 13 shows how an embodiment of the invention is assembled.

FIG. 13 shows how the three main components of the invention (the sidewalls of the cone 41, the back of the cone 42 and the rectangular tab 43) can be assembled to construct the invention. The rectangular tab 43 is attached to the sidewalls 41 of the cone so that the tab sits in the middle of the cone enclosing the tip 44 of the cone within the tab. The back of the cone 42 is circular in shape and is attached to the sidewalls 41 of the cone. FIG. 13 also shows the three regions of the cone: the top region 49, the middle region 52, and the lower region 54; the upper dividing line 51 and the lower dividing line 53 separating the regions of the cone; the side seam 68 of the cone; the lower side 65 of the walls which will be attached to the back of the cone 42; the two regions of the tab 43: the extra rigid and thicker region 50 below the scoreline 48, and the less rigid, thinner region 46 above the scoreline 48; and the two triangular notches 45 at both sides of the tab 43. The manufacturing of the present invention in its preferred embodiment generally involves four steps. In a first step, to form the dispenser, a sheet as shown in FIG. 10 is folded to create the sidewalls of the cone 41. In a second step, the rectangular tab 43 is attached on top of the sidewalls, as shown in FIG. 13. The tab 43 might be manufactured in various embodiments as described in greater detail below. In a third step, the container is filled with the fluid or semi-fluid substance to be contained and dispensed. In a final step, the back of the cone 42 is attached to the sidewalls. As an alternative to the sequence of step three and four, the back of the cone 42 could be sealed partially. During filling the non-sealed part of the bottom seam may be opened to allow filling, for example, by means of a separator with suction cups. The remainder of the seam is then sealed.

It will be obvious to those skilled in the art that alternative processes and manufacturing procedures may become apparent which enable the assembly of the dispenser as shown in FIG. 1. Also, it will also be obvious that sheets in different shapes might be used to manufacture the dispenser in a more economical or efficient manner, or that the shape of the sheets as described above may be slightly adjusted or cut to facilitate or accommodate the welding, gluing or attaching of the various components of the dispenser. In addition, it will be obvious that there are a variety of materials by which the various regions and parts of the invention can be welded, glued—using polymer or other substances—, or otherwise attached to each other, and that there are a variety of different methods and procedures by which such welding, gluing or attaching may be realized.

FIGS. 14, 15, 16, 17, 18 and 19 show different embodiments of the rectangular tab 43 before it has been attached to the sidewalls 41. To these various embodiments of the tab, the other components of the dispenser, as described above, may be attached in a manner, also as described above. In FIG. 14, the upper region 46 of the tab is longer in length than in FIG. 1. Such embodiment has the advantage that the user of the dispenser has more grip on the upper region and therefore can more easily tear off that region to open the dispenser. FIG. 15 shows a side view of the tab 43 taken approximately along the line 15—15 of FIG. 14 showing the great difference in width between the extra rigid and thicker lower region 50 and the less rigid, thinner upper region 46. FIG. 15 also shows how there is a transition section 80 from the lower, thicker region 50 to the upper, thinner region 46 at the lower part of the triangular notch 45.

Figure 16:
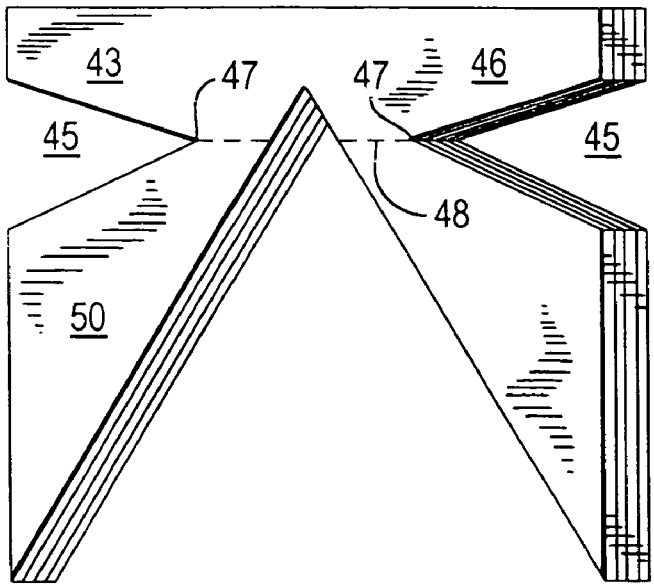

FIG. 16 shows an embodiment of the tab where the triangular notch 45 goes much deeper into to the tab 43 so that the inner tip 47 of either triangular notch 45 is located much nearer to the area where the tip of the cone will be located. In such embodiment, the perforated or indented scoreline 48 is also shorter so that the user of the dispenser must make less of a tearing effort to remove the upper region 46 of the tab and the upper region 49 of the cone.

Figure 17:
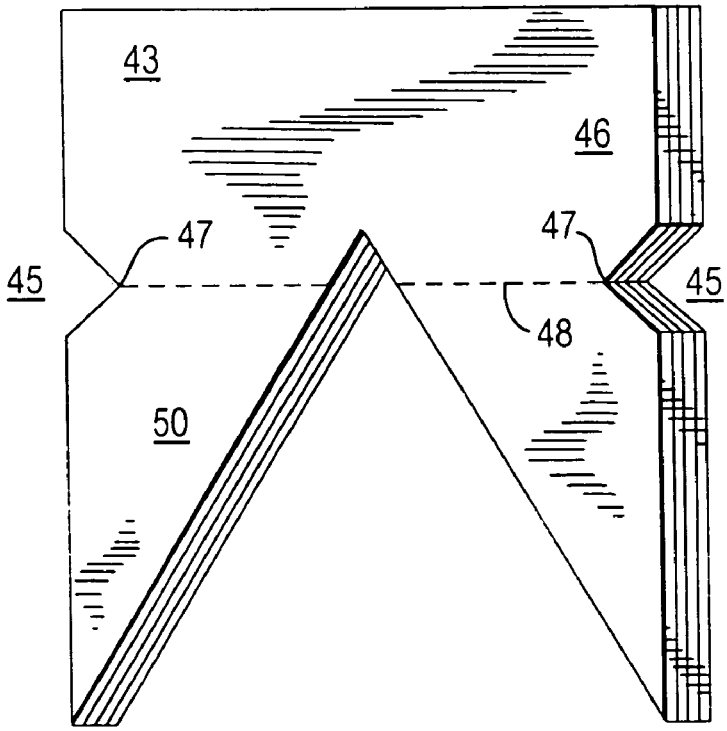

FIG. 17 shows another embodiment of the tab where the upper region 46 of the tab is longer in length than in FIG. 1 and where the triangular notch 45 does not go as deep into to the tab 43 so that the inner tip 47 of either triangular notch 45 is located further away from the area where the tip of the cone will be located. In such embodiment, the perforated or indented scoreline 48 is also longer. In addition, the lower region 50 and the upper region 46 of the tab in FIG. 17 have the same or similar thickness.

Figure 18:
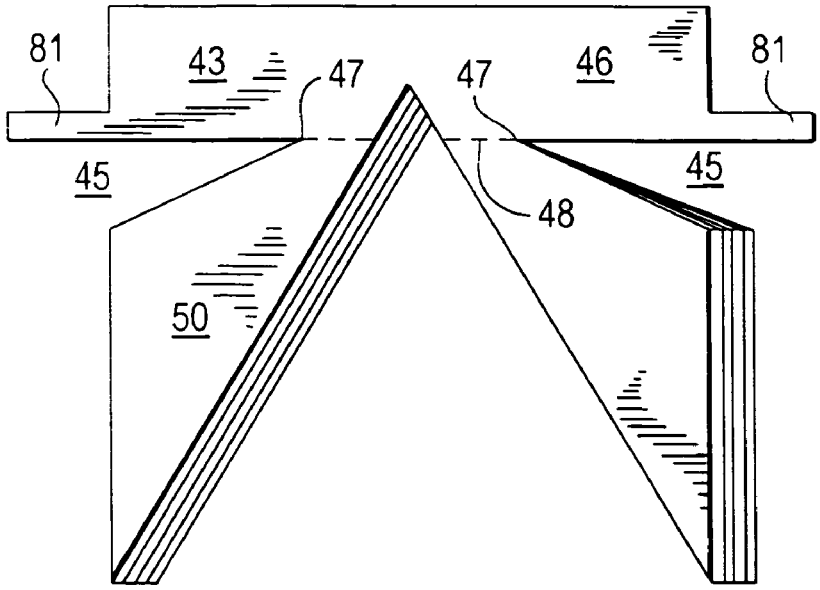

FIG. 18 shows yet another embodiment of the tab where upper region 46 of the tab features an additional stub 81 right above the two triangular notches 45. The additional stub 81 may be an integrated part of, and therefore made in the same material as, the upper region 46 or may be made in material that is even more flexible and thin than the rest of the upper region 46.

Figure 19:
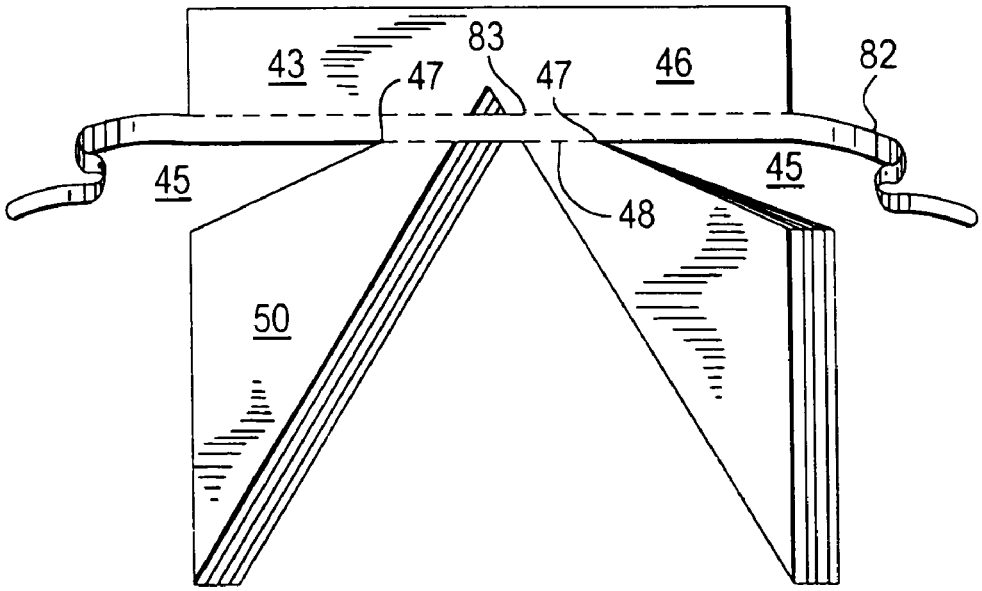

FIG. 19 shows an embodiment of the tab where a yarn or thread 82 is incorporated into the upper region 46 right above the perforated or indented scoreline 48. An additional perforated scoreline 83 is made right above the yarn or thread 82. The user of the dispenser who wants to open the dispenser can remove the upper region 46 of the tab and the top region 49 of the cone in a simple manner by pulling the yarn or thread 82, part of which is hanging loose on the side of the tab at the height of the triangular notch so the user can easily seize the yarn or thread 82. The yarn or thread may be made of a material chosen from paper, plastic, tin foil, metal, fiber or a combination thereof. Alternatively, the yarn or thread 82 may be made of the same or a similar material as the material of the upper region 46 of the tab. Also, rather than incorporating the yarn or thread 82 into the upper region 46, it may be attached on the upper region, either before the tab 43 is attached to the sidewalls 41 of the cone, or after.

Figure 20:
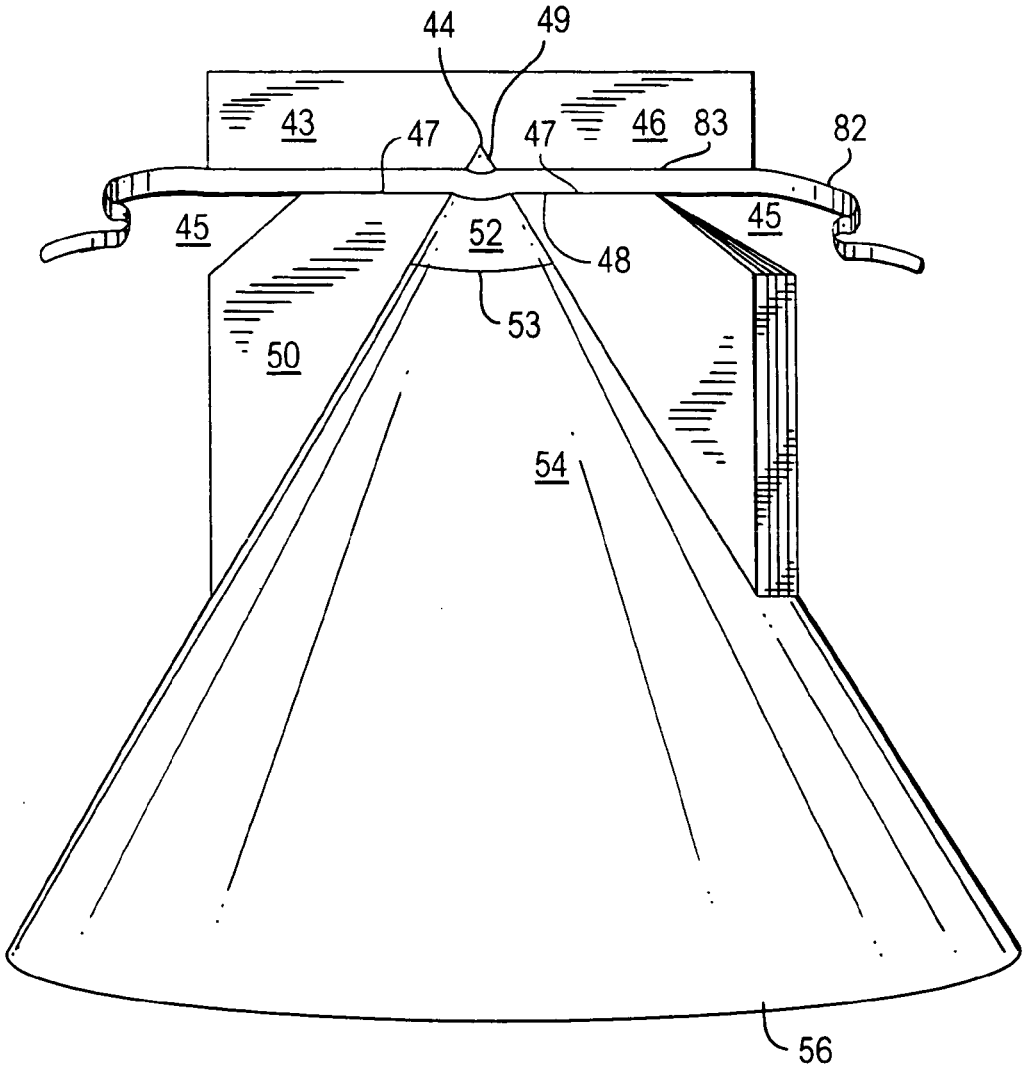
FIG. 20 shows an embodiment of the invention incorporating the embodiment of one component of the invention as shown in FIG. 19.

FIG. 20 shows a view of a complete view of the embodiment of the invention in which a yarn or thread 82 is attached to the upper region 46 as described above in reference to FIG. 19. In addition to being aligned between the perforated or indented scoreline 48 and the additional scoreline 83, the yarn or thread 82 is also wrapped around the top region 49 of the cone on one side of the tab. Alternatively, two yarns or threads may run parallel along the scorelines while one of the yarns or threads wraps around the top region 49 on one side of the tab, and the other yarn or thread wraps around the top region 49 on the other side of the tab.

It will be obvious that the tab 43 can be manufactured in a wide range of sizes, lengths and widths, which may contain any of the features of the embodiments described above.

The present invention addresses the need for a dispenser as described above. The dispenser can be used for a variety of fluid or semi-fluid substances including, but not limited to, any type of sauce such as ketchup, mayonnaise or salad dressing, spread-able cheese, chocolate paste, coffee cream, other prepared foods, as well non-edible liquid or semi-liquid consumer products such as conditioner or shampoo, hair gels, liquid soap or tooth paste. The invention obviates the need for a utensil to open the dispenser and is therefore suitable for instances where a utensil would be excessively burdensome or not practical. The conical shape and the rigid rectangular stub allow the users of the dispenser to apply the substance contained within the dispenser in a measured and precise manner, where they want it and in the volume they want it, in a very easy and convenient manner. Because the dispenser is re-sealable, users of the dispenser can dispense the substance contained within at various times.

What has been illustrated and described herein is an improvement in certain types of squeezable articles of manufacture such as fluid containers made of flexible material.

While the improvements have been illustrated and described with reference to certain preferred embodiments, the present invention is not limited thereto. In particular, the foregoing specification and embodiments are intended to be illustrative and are not to be taken as limiting. Thus, alternatives, such as structural or mechanical equivalents, or alternative methodologies of manufacturing the present invention, and other modifications will become apparent to those skilled in the art upon reading the foregoing description. Accordingly, such alternatives, changes, methodologies and modifications are to be considered as forming a part of the present invention insofar as they fall within the spirit and scope of the appended claims.

I claim:

1. A conical-shaped container for containing one of a liquid and a semi-liquid substance, the container comprising:

a conical main body formed of a collapsible material; and a rectangularly-shaped rigid tab attached to a top of the conical main body and including a top region formed to hold the top of the conical main body and a bottom region, wherein the bottom region is more rigid than the top region, a notch is formed in a transitional section formed between the bottom region and the top region, the top of the conical main body is formed of a different material than a bottom of the conical main body, and the transitional section of the rectangularly-shaped rigid tab is formed as a zone of weakness to enable a tearing of the top region holding the top of the conical main body from the bottom region, thereby opening the conical main body.

2. The container as claimed in claim 1, wherein the different material forming the top of the conical main body is a foil-like material so that the foil-like material is resealable by pressing the foil-like material.

3. The container as claimed in claim 1, wherein the transitional section is indented to form the zone of weakness.

4. The container as claimed in claim 1, wherein the transitional section is perforated to form the zone of weakness.

5. The container as claimed in claim 1, wherein walls of the top of the conical main body are indented at a same height as the transitional section.

6. The container as claimed in claim 1, further comprising a thread attached to the transitional section and the top of the conical main body.

7. The container as claimed in claim 1, wherein the conical main body is formed of a layer of one of paper, plastic, tin foil, metal, and a combination thereof.

* * * * *